United States Patent [19]

Fung

[11] Patent Number: 4,977,489

[45] Date of Patent: Dec. 11, 1990

[54] PORTABLE BATTERY OPERATED LIGHTING DEVICE

[75] Inventor: Shiu P. Fung, Kwai Chung, Hong Kong

[73] Assignee: Fatia Industrial Co., Ltd., Kwai Chung, Hong Kong

[21] Appl. No.: 450,436

[22] Filed: Dec. 14, 1989

[51] Int. Cl.[5] ..... F21L 11/00

[52] U.S. Cl. ..... 362/184; 362/199; 362/287; 362/427

[58] Field of Search ..... 362/184, 190, 197, 199, 362/217, 236, 287, 427, 228, 231

[56] References Cited

U.S. PATENT DOCUMENTS 2,959,667 11/1960 Cheng ..... 362/184

4,321,657 3/1982 Hoi ..... 362/184 X 4,467,403 8/1984 May ..... 362/184 X

*Primary Examiner*—Stephen F. Husar

*Attorney, Agent, or Firm*—Burns, Doane, Swecker & Mathis

[57] ABSTRACT

A portable battery operated lighting device includes a first housing which is elongated for receiving at least one battery, a second housing at one end of the first housing which includes a first light source and which is capable of acting as a base for the device, and a third housing which is pivotally connected to the other end of the first housing and which includes at least a second light source. The third housing is pivotable between a position in which it is parallel to the first housing and a position in which it is at an angle to the first housing.

7 Claims, 3 Drawing Sheets

PORTABLE BATTERY OPERATED LIGHTING DEVICE

The present invention relates to portable battery operated lighting devices capable of being operated in more than one mode.

Lighting devices of the type mentioned are well-known. One example comprises a lamp which may be carried in the boot of a car and which may be operated either as an orange hazard warning signal light to warn off other motorists, or as a constant white light for illumination purposes.

The present invention provides a particularly advantageous arrangement of lighting device of the type described which comprises:

a first housing of elongate shape for receiving a battery;

a second housing at one end of the first housing and provided with a light source for producing a beam of light, the second housing also being capable of acting as a base on which the device may be stood; and a third housing including a second light source, the third housing being pivotally connected to the other end of the first housing, so as to be movable between two different positions in one of which the third housing lies parallel to and side by side with the first housing.

The device in accordance with the invention may be used in either one of two modes. In the first mode the device may be used as a handheld torch by disposing the third housing in a first position parallel to and by side by side with the first housing so that together they form a convenient handle, and then connecting the battery to the first light source to produce a beam of light. In the second mode, the device may be used as a free standing light, by standing the device on the second housing, and disposing the third housing in the alternative position, and then connecting the battery to the second light source.

One construction of device according to the invention will now be described more particularly, by way of example only, with reference to the accompanying drawings. In the drawings.

Figure 1:
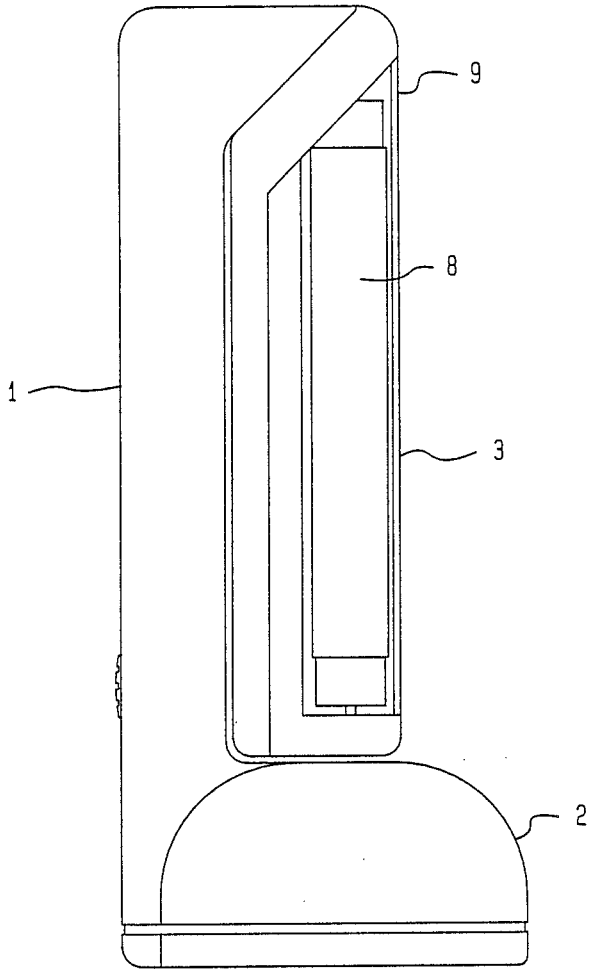
FIG. 1 is a side view of the device arranged as a handheld torch.

Referring now to the drawings, the device comprises three housings 1, 2, 3. The first housing 1 is of elongate shape and accommodates batteries 4, the second housing 2 is of generally hemispherical shape and is located at one end of the first housing 1 and is formed integrally therewith, and accommodates a lightbulb 5, reflector 6 and lens 7 for producing a beam of light. The third housing 3 is of elongate shape and is pivotally connected to the other end of the first housing 1 and includes a fluorescent light 8 and lens 9 for producing a constant white light for widely dispersed illumination, and further includes a hazard warning light 10 and lens 11 for producing an orange warning signal.

The device illustrated in the drawings may be used in any one of three modes, namely as a handheld torch, as a free standing fluorescent light, or as a free standing hazard warning light.

FIG. 1 shows the device disposed for use in the first mode as a handheld torch or flashlight. It will be noted that the housing 1 and the housing 3 are parallel and side by side and define a convenient handle for holding the torch.

Figure 2:
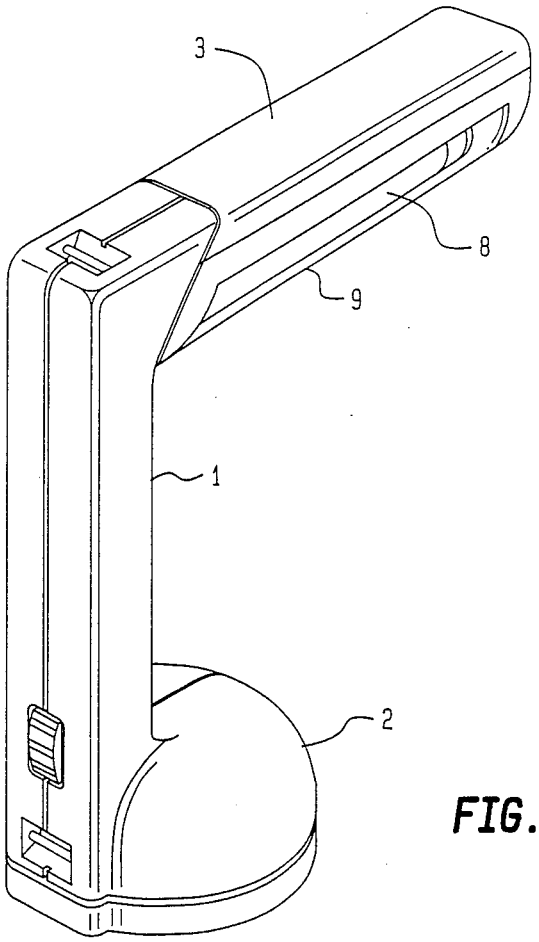
FIG. 2 is a perspective view of the device arranged as a free standing light source.

FIG. 2 shows the device disposed for use in the second or third modes. The device stands on the second housing 2 which serves as a base, and the housing 3 is disposed at right angles to the battery housing 1.

Figure 3:
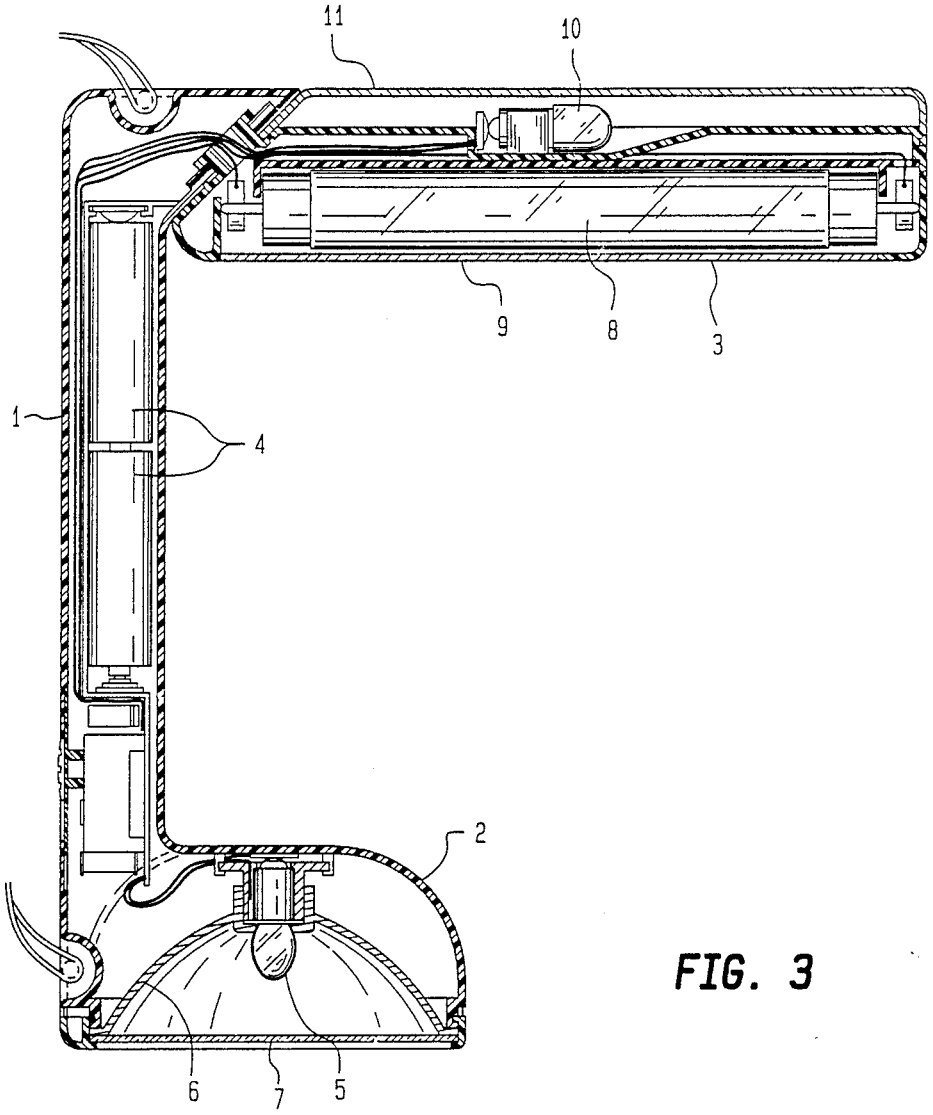
FIG. 3 is a sectional side elevation of the device arranged as a free standing light, the dashed lines in the figure indicating the device arranged as a handheld torch.

FIG. 3 shows the internal construction of the device. In particular FIG. 3 shows the pivot joint between housing 1 and housing 3. To prevent the electrical leads from becoming twisted due to repeated conversion from one disposition of the housing 3 to the other disposition of the housing 3, the pivot joint permits rotation through 180 degrees only and not through 360 degrees so that during conversion the housing 3 is always folded back in the opposite direction to that in which it was opened out.

What is claimed is:

1. A portable battery operated lighting device capable of being operated in more than one mode, comprising:

a first elongated housing for receiving a battery;

a second housing fixedly connected to one end of said first housing and including a first light source for producing a beam of light, said second housing being capable of acting as a base on which said device may stand; and a third housing including a second light source different from the first light source, said third housing being pivotally connected by means of a pivot joint to the other end of said first housing so as to be movable between two different positions, a first position in which said third housing lies parallel to and side by side with said first housing so that together said first and third housings form a handle which, with said first light source switched on, allows said device to be used in a first mode as a hand-held flashlight, and a second position in which said third housing is at an angle to said first housing which, with said second light source switched on and said device standing on said second housing, allows said device to be used in a second mode as a free standing light.

2. A lighting device according to claim 1, wherein said third housing includes two light sources which are different from one another and from said first light source.

3. A lighting device according to claim 1, wherein said pivot joint constrains said third housing to move from said first position to said second position only in an opposite direction to movement of said third housing from said second position to said first position.

4. A portable battery operated lighting device, comprising:

a first elongated housing for receiving at least one battery;

a second housing at one end of said first housing and including a first light source for producing a beam of light, said second housing being capable of acting as a base on which said device may stand; and a third housing including both a second light source and a third light source, said second and third light sources being different from one another and from said first light source, said third housing being pivotally connected to the other end of said first housing so as to be movable between two different positions, said third housing lying parallel to and side by side with said first housing in one of said positions.

5. A portable lighting device, comprising:

a first elongated housing for receiving at least one battery;

a second housing fixedly connected to one end of said first housing such that said second housing is usable as a base on which said device may stand, said second housing including a first light source for producing a beam of light; and a third housing including a second light source, said third housing being pivotally connected to the opposite end of said first housing so as to be movable between at least two different positions.

6. A portable lighting device according to claim 5, wherein said third housing also includes a third light source.

7. A portable lighting device according to claim 5, wherein said third housing is movable between a first position in which said third housing lies parallel to said first housing such that said first and third housings together form a handle which, with said first light source switched on, allows said device to be used as a hand held flashlight, and a second position in which said third housing is at an angle to said first housing which, with said second light source switched on and said device standing on said second housing, allows said device to be used as a free standing light.

* * * * *